US005622333A

United States Patent [19]

Jacques

[11] Patent Number: 5,622,333

[45] Date of Patent: Apr. 22, 1997

[54] ADJUSTABLE WIRE REEL

[75] Inventor: Michel Jacques, St-Damien-de-Buckland, Canada

[73] Assignee: IPL Inc., St-Damien-de-Bellechasse, Canada

[21] Appl. No.: 582,273

[22] Filed: Jan. 3, 1996

[51] Int. Cl.[6] ..... B65H 75/24

[52] U.S. Cl. ..... 242/578.2; 242/118.5

[58] Field of Search ..... 242/578.2, 118.5

[56] References Cited

U.S. PATENT DOCUMENTS 4,428,546 1/1984 Weideman ..... 242/578.1

4,570,869 2/1986 Tsuji ..... 242/578.2

*Primary Examiner*—John Q. Nguyen

*Attorney, Agent, or Firm*—Dvorak and Traub

[57] ABSTRACT

An adjustable wire reel that is formed of a pair of identical reel members made of plastics material which are interlocked to one another. Each reel member is provided with a series of circumferentially spaced barrel sections having at their extremities tongues which engage cooperating slots on the inner side of the opposite reel member. This inner side is provided with stepped surfaces in which these slots are provided so that the reel members may be interlocked in any one of these stepped surfaces so as to provide a reel with various spacings between flange portions of the reel members.

8 Claims, 4 Drawing Sheets

ADJUSTABLE WIRE REEL

FIELD OF THE INVENTION

The present invention pertains to reels for winding wire, cable or like winding material thereon; more particularly, the present invention pertains to an adjustable reel so that the spacing between the opposite flange portions of the reel may be varied according to need.

BACKGROUND OF THE INVENTION

There are numerous constructions of wire or cable storage reels. Basically, each reel consists of a pair of opposite members with flanges interconnected by a barrel portion. Manufacturers of reels must supply various sizes of reels to suit various needs. Some reels have their flanges and barrel portion fixedly interconnected to one another. Other reels have one flange detachable from the barrel portion which, in turn, is fixedly secured to the other flange. One advantage of having at least one flange removable is that the reel occupy less space when they are transported or stored without a wound material thereon. Obviously, less space is required if all three reel components are dismountable.

One disadvantage of reels having two or three components each having a different configuration is that stocks of these various components must be kept and made available for such replacement of damaged components.

OBJECT AND STATEMENT OF THE INVENTION

It is an object of the present invention to provide a reel which overcomes the above problem of stock and storage space and consists of only two components, both being identically constructed.

It is a further object of the present invention to provide an adjustable reel which, in addition of having identical components, are constructed in such a way as to provide two or more sizes, in other words, wherein the spacing between the reel components may be varied according to need.

The present invention therefore relates to an adjustable wire or cable reel which comprises a pair of identical opposite reel members interlocked with one another; the reel members have respective flange portions spaced from one another to define a winding receiving spacing therebetween and respective hub portions engaged to one another; each hub portion defines an inner side displaying a series of circumferentially spaced barrel sections, each barrel section having a winding receiving face and an outer face contacting part of the inner side of the opposite reel member; means on the outer face of the barrel section cooperate with means on the inner side of the opposite reel member for lockingly engage the reel members to one another to thereby define a first spacing between the flange portions; the inner side of each reel member has stepped surfaces with means cooperating with the said means on the outer face of the barrel section of the opposite reel member for lockingly engage the reel members to one another to thereby define a second spacing which is greater than the first spacing whereby the reel is adjustable in width.

In one form of the invention, the cooperating means consist of tongue means and of slot means.

In a further form of the invention, the opposite reel members are formed of plastics material so that the tongue means and slot means may cooperate to lock the reel members to one another due to the resiliency of the plastics material.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

DESCRIPTION OF PREFERRED EMBODIMENT

Figure 1:
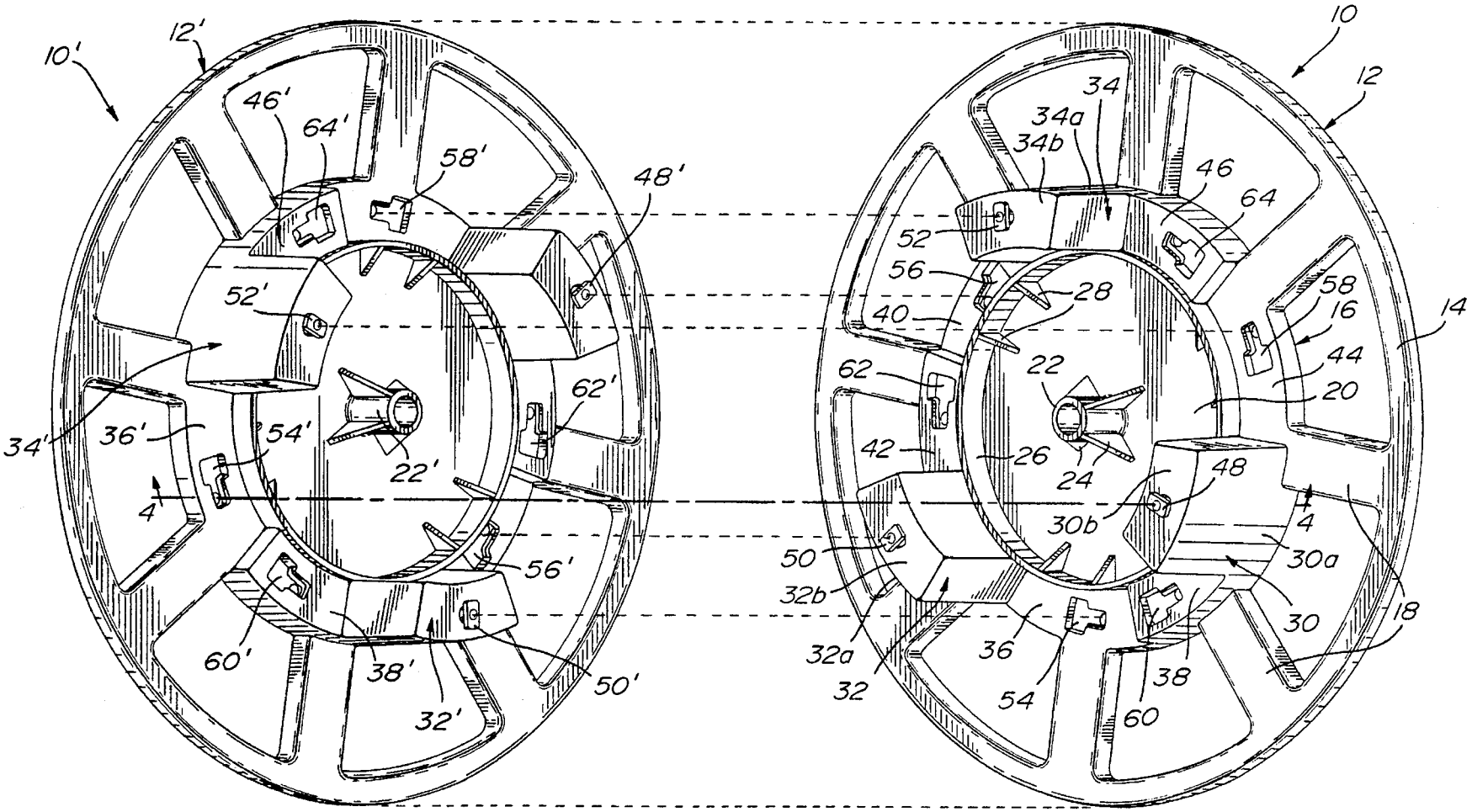
FIG. 1 is an exploded view of a reel made in accordance with the present invention.
Figure 2:
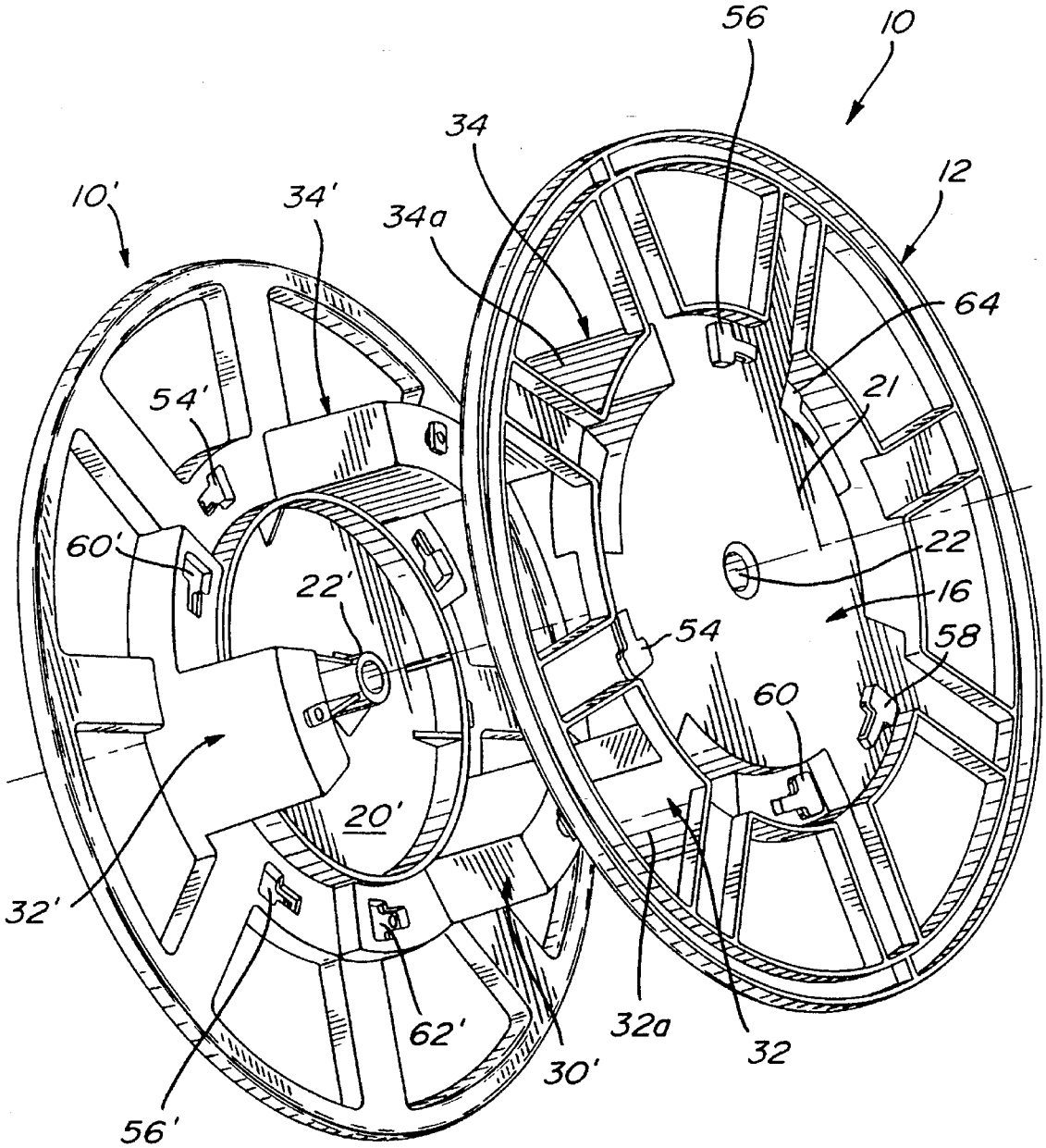
FIG. 2 is a side perspective view of the two reel members prior to engagement.

Referring to FIGS. 1 and 2, there is shown a pair of identical reel members 10 and 10' which, when interlocked with one another, form a reel on which material such as wire, cable or the like may be wound. Since the reel members are completely identical, a description of one reel member 10 will only be given. All parts or components of the reel member 10' should therefore also be considered described by the description of the parts and components of reel member 10; however, in the drawings, they will differ only by the presence of a prime mark to their reference numeral.

Reel member 10 is formed of a unitary body of plastics material having a flange portion 12 including a rim portion 14 which is connected to a hub portion 16 by means of a series of circumferentially spaced radially extending connections 18 having a U-shaped configuration (as seen in FIG. 2).

The hub portion 16 of the reel member consists of a circular central portion having an inner side 20 and an outer side 21. From the center of the inner side 20 an integrally formed cylindrical extension 22, equipped with a series of circumferentially spaced reinforcing ribs 24, is displayed. The inner side 20 has an annular rim portion 26 equipped with a series of reinforcing ribs 28. The inner side of the hub portion further includes, in the embodiment illustrated in the figures, three circumferentially spaced barrel sections 30, 32 and 34 between which are displayed six surfaces 36, 38, 40, 42, 44 and 46, each successive surface being stepped relative to its adjacent surface. All of these barrel sections and stepped surfaces are included within annular contour bound by the rim portion 26 and the radial extensions 18.

Each barrel section 30, 32, 34 comprises a respective wire receiving rounded surface **30*a*, 32*a*, 34*a* extending perpendicularly to the inner side of the reel member and an outer face 30*b*, 32*b*, 34*b*** extending in a plane parallel to that of the inner side of the reel member. In the center of each outer face 30*b*, 32*b*, 34*b* extends a respective T-shaped tongue 48, 50, 52. Faces 36, 40 and 44 are co-planar to one another but offset radially with respect to their respective adjacent surface 38, 42 and 46. In all of these surfaces there are provided respective T-shaped slots 54, 56, 58, 60, 62, 64.

Figure 3:
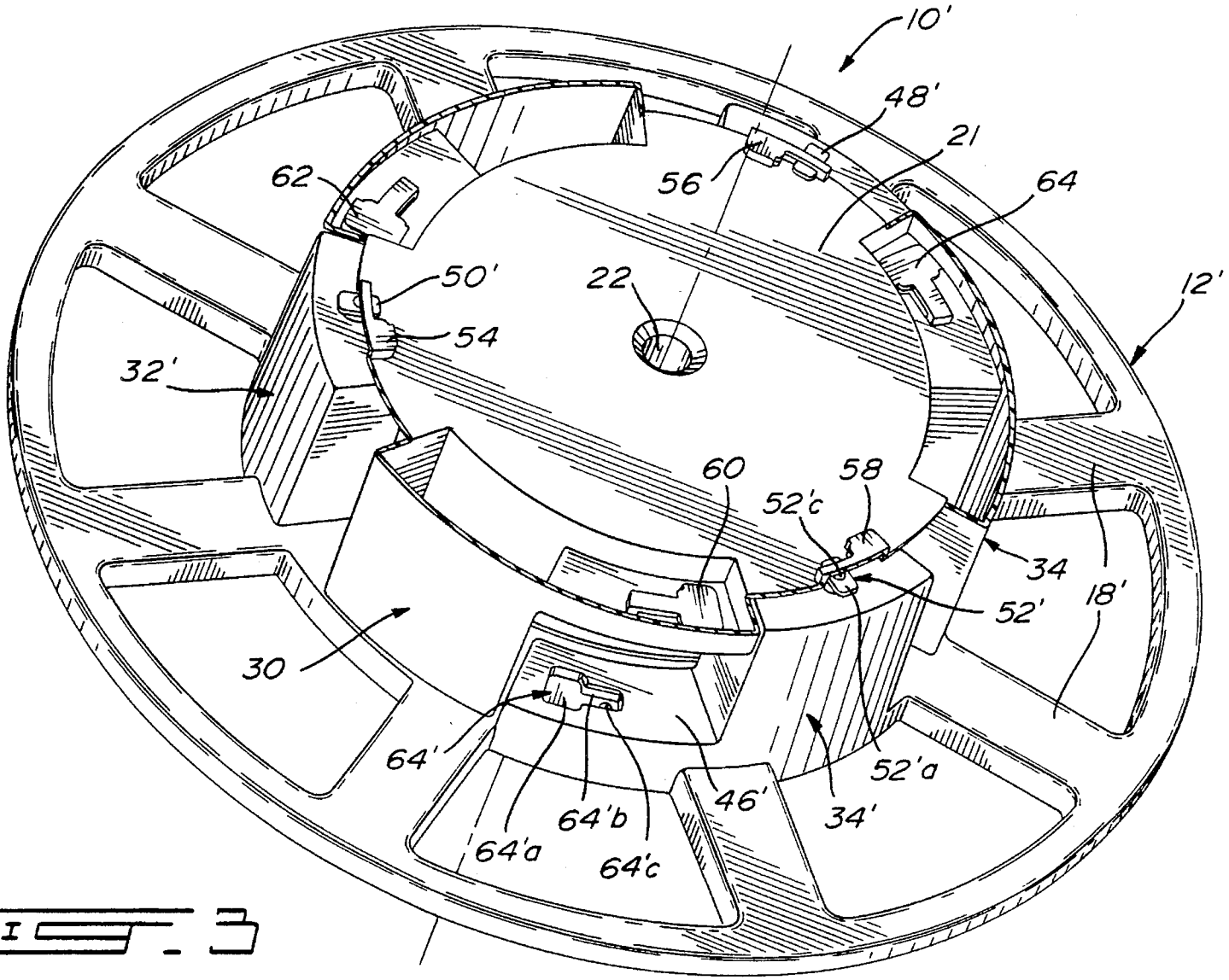
FIG. 3 is a perspective view of one reel member showing parts thereof engaged with a broken away part of the opposite reel member.

The tongues are identically shaped as well as the slots in the stepped surfaces. With reference to FIG. 3, one of these tongues will now be described in detail as well as one of these slots. Tongue 52', for example, comprises a flat rectangular top wall 52'*a* supported by a hollow stem (see stem 48*b* in FIG. 6); the top wall 52'*a* displays centrally thereof a semi-spherical protuberance 52'*c* Slot 64' for example, defines a T-shaped cavity formed in the surface 46'; it consists of a large opening 64'*a* having a width slightly greater than the width of the top wall (for example, 52'*a*) of a tongue and of a stem receiving narrow elongated opening 64'*b*, the bottom wall of which has a semi-spherical recess 64'*c* having a size complementary to the semi-spherical protuberance (for example, 52'*c*) of a tongue. As can also be seen in FIG. 3, the cavities 54, 56, 58 extend beyond the face of the rear side 21 of the hub portion while the other cavities 60, 62, 64 are recessed relative thereto. As can be further seen, the barrel sections of the reel members are cavities.

Figure 4:
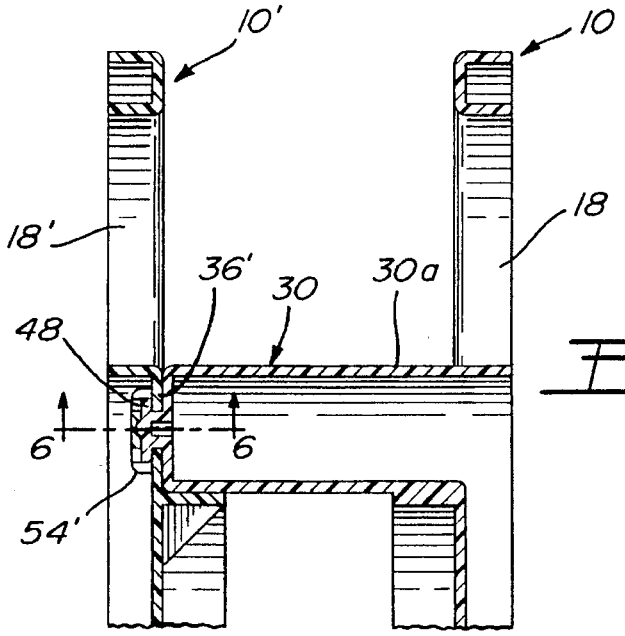
FIG. 4 is a sectional view taken along line 4—4 of FIG. 1 showing two reel members with a first spacing between its flange portions.
Figure 5:
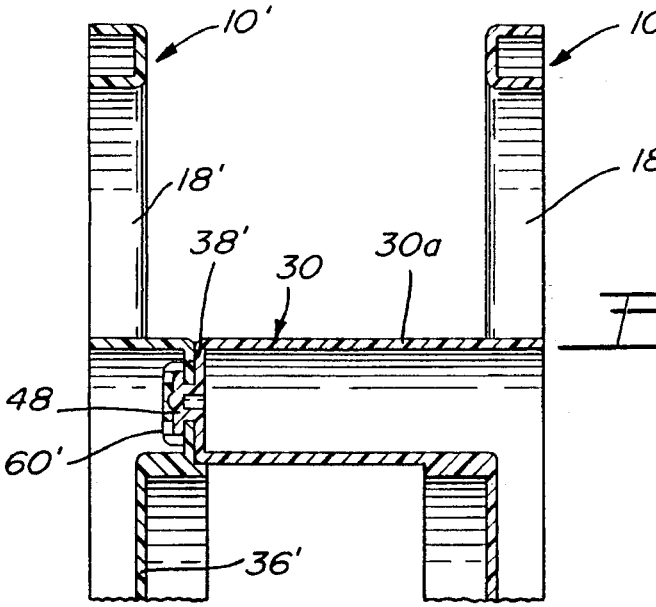
FIG. 5 is a sectional view similar to FIG. 4 showing the two reel members with a second spacing between its flange portions.

An important feature of the present invention is that the two reel members 10 and 10', may be assembled together to provide different spacings between flange portions 12, 12' of the reel members. Indeed, if tongues 48, 50 and 52 are received in slots 54', 56' and 58' the spacing separating the flange portions will be smaller (see FIG. 4) than that separating the flange portions if tongues 48, 50 and 52 are engaged in the slots 60', 62' and 64' (see FIG. 5).

Figure 6:
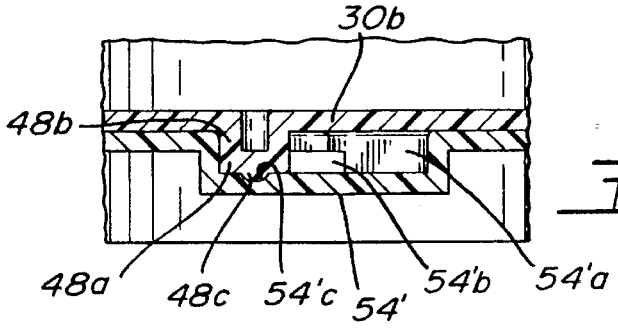
FIG. 6 is a cross-sectional view taken along lines 6—6 of FIG. 4.

In order to assemble the two reel members together, the tongues of each reel member are brought into registry with the large openings of the slots of either one of the two stepped surfaces. With reference to FIG. 6, the top part of each tongue penetrates into the large opening of its corresponding slot and then by a clockwise rotation of one reel member and a counter-clockwise rotation of the other reel member, the tongues are moved through the narrow openings of the slots. The dimensions of the narrow openings are such that, due to the resiliency of the plastics material of which is made the reel members, a secured inter-engagement is obtained by forcing the engagement so that the semi-spherical protuberances on the top wall of the tongues are engaged in their corresponding semi-spherical recesses in the lower wall of the narrow openings. To disassemble the engaged reel members, a similar clockwise and counter-clockwise rotation is carried out whereby the tongues are slid out of their engagement with the protuberances and narrow openings to the large openings and then retracted out of the large openings.

Although the invention has been described above with respect with one specific form, it will be evident to a person skilled in the art that it may be modified and refined in various ways. For example, a greater number of stepped surfaces may be provided so that more than two spacings may be achieved between the reel members. It has also been found that the rim portion 14, 14' can be made by gas-injected molding so as to provide an enclosed rim rather than the U-shaped cross-section illustrated in the drawings. It is therefore wished to have it understood that the present invention should not be limited in scope, except by the terms of the following claims.

The embodiments of the invention in which an exclusive property or privilege is claimed are defined as follows:

1. An adjustable wire reel comprising a pair of identical opposite reel members interlocked with one another; said reel members having respective flange portions spaced from one another to define a winding receiving spacing therebetween and respective hub portions engaged to one another; each said hub portion defining an inner side displaying a series of circumferentially spaced barrel sections, each said barrel section having a winding receiving face and an axially outer face contacting part of the inner side of the opposite reel member; means on said outer face of said barrel section cooperating with means on said inner side of the opposite reel member for lockingly engaging said reel members to one another to thereby define a first spacing between said flange portions; said inner side of each reel member having axially stepped surfaces each having said means cooperating with said means of said outer face of said barrel section of the opposite reel member for lockingly engaging said reel members to one another to thereby define different spacings between said flange portions whereby said wire reel is adjustable in width.

2. An adjustable wire reel as defined in claim 1, wherein said barrel sections and said stepped surfaces on each reel member extend annularly on said inner side thereof.

3. An adjustable wire reel as defined in claim 2, wherein said cooperating means on said outer face of said barrel sections consist of tongue means for lockingly engaging slot means; said cooperating means on said inner side and on said stepped surfaces consist of said slots means for receiving said tongue means; said tongue means being shaped to be received in said slot means and to be tightly engaged therein for lockingly securing said reel members together.

4. An adjustable wire reel as defined in claim 3, wherein each said slot means defines a first receiving opening adapted to receive said tongue means therein and a second securing opening adapted to secure said tongue means therein whereby rotational movements of said reel members relative to one another cause said tongue means to move from said receiving opening to said securing opening.

5. An adjustable wire reel as defined in claim 4, wherein said tongue means are T-shaped tongues and wherein said first and second openings define a T-shaped slot.

6. An adjustable wire reel as defined in claim 5, wherein said reel members are made of plastics material; said T-shaped tongues being resiliently engaged in said second securing opening.

7. An adjustable wire reel as defined in claim 6, wherein each said T-shaped tongue displays a semi-spherical protuberance on a top wall thereof and wherein each said second receiving opening displays a semi-spherical recess in a bottom wall therein; said protuberance being received in said recess when said reel members are resiliently engaged with one another.

8. An adjustable wire reel as defined in claim 2, wherein said inner side of said hub portion defines a central circular face having, centrally thereof, an integrally-formed tubular projection adapted to receive therein a cylindrical support for said wire reel.

* * * * *